US008864870B1

(12) United States Patent
Anderson et al.

(10) Patent No.: US 8,864,870 B1
(45) Date of Patent: Oct. 21, 2014

(54) DISPERSOID REINFORCED ALLOY POWDER AND METHOD OF MAKING

(75) Inventors: Iver E. Anderson, Ames, IA (US); Robert L. Terpstra, Ames, IA (US)

(73) Assignee: Iowa State University Research Foundation, Inc., Ames, IA (US)

( * ) Notice: Subject to any disclaimer, the term of this patent is extended or adjusted under 35 U.S.C. 154(b) by 40 days.

(21) Appl. No.: 13/506,683

(22) Filed: May 9, 2012

Related U.S. Application Data

(62) Division of application No. 12/660,354, filed on Feb. 25, 2010, now Pat. No. 8,197,574, which is a division of application No. 11/429,918, filed on May 8, 2006, now Pat. No. 7,699,905.

(51) Int. Cl.
*C22C 19/03* (2006.01)
*C22C 1/10* (2006.01)

(52) U.S. Cl.
CPC ..... *C22C 19/03* (2013.01); *C22C 1/1042* (2013.01)
USPC ..... 75/235; 75/246; 148/426; 420/455

(58) Field of Classification Search
None
See application file for complete search history.

(56) References Cited

U.S. PATENT DOCUMENTS

| | | | | |
|---|---|---|---|---|
| 3,741,748 | A * | 6/1973 | Fustukian et al. | 75/252 |
| 3,775,100 | A * | 11/1973 | Kizer | 419/35 |
| 3,904,448 | A | 9/1975 | Takahashi et al. | 148/105 |
| 4,075,010 | A | 2/1978 | Fischer | 75/235 |
| 4,336,242 | A | 6/1982 | Schmidberger et al. | 423/594 |
| 4,402,770 | A | 9/1983 | Koon | 420/435 |
| 4,533,408 | A | 8/1985 | Koon | 148/103 |
| 4,585,473 | A | 4/1986 | Narasimhan et al. | 148/101 |
| 4,597,938 | A | 7/1986 | Matsuura et al. | 148/105 |
| 4,619,845 | A | 10/1986 | Ayers et al. | 427/422 |
| 4,758,405 | A | 7/1988 | Couper | 75/338 |
| 4,801,340 | A | 1/1989 | Inoue et al. | 148/103 |
| 4,802,931 | A | 2/1989 | Croat | 148/302 |
| 4,867,809 | A | 9/1989 | Haverstick | 148/101 |
| 4,919,845 | A | 4/1990 | Walz | 75/338 |
| 4,966,626 | A | 10/1990 | Fujiki | 75/238 |
| 4,999,052 | A | 3/1991 | Wilson | 75/338 |
| 5,024,695 | A | 6/1991 | Ashdown et al. | 75/338 |
| 5,073,409 | A | 12/1991 | Anderson et al. | 427/217 |
| 5,090,997 | A | 2/1992 | Birkenstock et al. | 75/338 |
| 5,114,470 | A | 5/1992 | Biancaniello et al. | 75/338 |
| 5,125,574 | A | 6/1992 | Anderson et al. | 239/8 |
| 5,190,701 | A | 3/1993 | Larsson | 75/338 |
| 5,196,049 | A | 3/1993 | Coombs et al. | 75/338 |
| 5,368,657 | A | 11/1994 | Anderson et al. | 148/400 |
| 5,372,629 | A | 12/1994 | Anderson et al. | 75/332 |
| 5,427,601 | A | 6/1995 | Harada | 75/235 |
| 5,462,808 | A | 10/1995 | Asabe | 428/551 |
| 5,489,324 | A | 2/1996 | Takahasi et al. | 75/246 |
| 5,615,406 | A * | 3/1997 | Sasaki et al. | 419/14 |
| 5,782,954 | A | 7/1998 | Luk | 252/175 |
| 5,908,486 | A | 6/1999 | Flynn | 75/232 |
| 6,375,705 | B1 | 4/2002 | Judkins | 75/235 |
| 2004/0131492 | A1 | 7/2004 | Kawakami et al. | 419/60 |
| 2005/0097986 | A1 * | 5/2005 | Okada et al. | 75/246 |

FOREIGN PATENT DOCUMENTS

| | | |
|---|---|---|
| JP | 63-100108 | 5/1988 |
| JP | 63-109101 | 6/1988 |

OTHER PUBLICATIONS

"Simplified Powder Processing of Oxide Dispersion Stregnthened (OSD) Stainless Steel", MPIF-APMI International Conference on Powder Metallurgy and Particulate Materials 2006, San Diego, California, 2006.

* cited by examiner

*Primary Examiner* — George Wyszomierski

(57) ABSTRACT

A method of making dispersion-strengthened alloy particles involves melting an alloy having a corrosion and/or oxidation resistance-imparting alloying element, a dispersoid-forming element, and a matrix metal wherein the dispersoid-forming element exhibits a greater tendency to react with a reactive species acquired from an atomizing gas than does the alloying element. The melted alloy is atomized with the atomizing gas including the reactive species to form atomized particles so that the reactive species is (a) dissolved in solid solution to a depth below the surface of atomized particles and/or (b) reacted with the dispersoid-forming element to form dispersoids in the atomized particles to a depth below the surface of said atomized particles. Bodies made from the dispersion strengthened solidified particles exhibit enhanced fatigue and creep resistance and reduced wear as well as enhanced corrosion and/or oxidation resistance at high temperatures.

12 Claims, 8 Drawing Sheets

DISPERSOID REINFORCED ALLOY POWDER AND METHOD OF MAKING

This application is a division of U.S. application Ser. No. 12/660,354 filed Feb. 25, 2010, now U.S. Pat. No. 8,197,574, which is a division of U.S. application Ser. No. 11/429,918 filed May 8, 2006, now U.S. Pat. No. 7,699,905.

CONTRACTUAL ORIGIN OF THE INVENTION

The United States Government has rights in this invention pursuant to Contract No. W-7405-ENG-82 between the U.S. Department of Energy and Iowa State University.

FIELD OF THE INVENTION

The present invention relates to a method of making dispersoid strengthened, corrosion/oxidation resistant atomized alloy powder particles and to particles, deposits, and products formed therefrom.

BACKGROUND OF THE INVENTION

New types of IC (internal combustion) engines, both diesel and spark ignition, are being designed to burn alternative fuel mixtures. including pure hydrogen, and will present new, more challenging operating environment: (increased temperatures and corrosive gas content) for exhaust valves. Of the many components of IC engines, the engine exhaust valve is and will be one of the most challenging material systems. Each exhaust valve must resist exposure to hot (1400-1600° F.) oxidizing combustion exhaust and must achieve and retain a challenging set of physical properties, including resistance to high cycle fatigue, extreme surface wear. and long-term creep deformation.

Current exhaust valves are multi-component material systems that consist of different Fe-based alloys that are joined and coated with several types of oxidation and wear resistant layers and their manufacture has been optimized for current vehicle operating environments.

Some advanced materials been proposed over the years as substitutions for existing materials to extend the lifetime or improve the performance of exhaust valves, including cast/wrought Ti alloys and oxide dispersion hardened Fe-base superalloys that are consolidated from mechanically alloyed powder (metal/oxide) blends.

Dispersoid strengthened metallic material typically comprises a metal or alloy matrix having dispersoids distributed uniformly throughout for strength enhancing purposes. The mechanical alloying (MA) process, particularly at full industrial scale, to make disperoid strengthened materials can add considerable cost to the process of making some very attractive alloys for high temperature service in harsh environments. In fact, the largest facilities in the US for making these types of alloys, in Huntington, W. Va., owned by Huntington Alloys, Inc., were recently shut down and put up for sale. Probably the most successful product of the mechanical alloying process is termed MA 956 by Inco Alloys International, Inc., and consists of Fe-20Cr-4.5Al-0.5Ti-0.5$Y_2O_3$-0.05 C (in wt. %) that is an Fe-based alloy with dispersed $Y_2O_3$ particles for retained high temperature strength. In the manufacture of mill forms of MA 956 for example, the starting MA particulate is produced from a blend of Fe, Cr, and master alloy (Al—Ti, and Fe—C) powders, along with the addition of $Y_2O_3$ powder, which is milled for extended times (days) in a high energy milling unit, e.g., horizontal ball mill. Typically, the highly refined composite powders that result are consolidated by direct hot extrusion. Subsequent thermomechanical treatment, e.g., by hot rolling and high temperature heat treatment (1300 C) is needed to promote secondary recrystallization of the microstructure. This is needed to grow the grain size far coarser than the interparticle spacing of the dispersed $Y_2O_3$ particles (25 nm), which imparts some useful ductility to the final machined parts. Both the milling equipment and extensive milling time are very costly. well beyond normal ingot metallurgy processing steps for this class of alloys (either stainless steels or Ni-base superalloys) without dispersoids, although their high temperature strength retention can be superior.

Powder metallurgy methods represent one of the most cost effective materials processing approaches for mass production of high performance engine components, e.g., the universal displacement of cast steel by powder metallurgy (pressed/sintered/forged) processed steel for IC engine connecting rods.

Gas atomization is a commonly used technique for economically making fine metallic powder by melting the metallic material and then impinging a gas stream on the melt to atomize it into fine molten droplets that are rapidly solidified to form the powder. One particular gas atomization process is described in the Ayers and Anderson U.S. Pat. Nos. 4,619,845 wherein a molten stream is atomized by a supersonic carrier gas to yield fine metallic powder (e.g., powder sizes of 10 microns or less). Anderson U.S. Pat. Nos. 5,073,409 and 5,125,574 describe high pressure gas atomization of a melt in a manner to form a thin protective refractory nitride surface layer or film on the atomized powder particles. The '409 patent uses an atomizing gas, such as nitrogen, that selectively reacts with an alloy constituent to form the protective surface layer. The '574 patent uses an inert atomizing gas and a reactive gas contacted with the atomized droplets at a selected location downstream of the atomizing nozzle to form the protective layer. Various prior art techniques for forming protective layers on atomized powder by reacting a gaseous species with the melt, or a component of the melt, are discussed in these patents.

U.S. Pat. No. 5,368,657 discloses a powder making process called gas atomization reaction synthesis (GARS) wherein a superheated melt comprising a metallic material is formed and atomized with an atomizing gas to produce atomized particulates. The atomizing gas can comprise a carrier gas and a reactive gas or liquid that is reactive when dissolved in solid solution in the metallic material to form dispersoids therein. The temperature of the melt and the ratio of the carrier gas to the reactive gas are selected effective to provide a superequilibrium concentration of reactive species, such as nitrogen, in solid solution in at least a surface region of the atomized particulates. The atomized particulates can be heated to a temperature to react the dissolved species with the metallic material to form dispersoids therein. Alternately, the atomized particulates having a superequilibrium concentration of the dissolved species are formed into an article, and the article then is heated to a temperature to react the dissolved species with the metallic material to form dispersoids in the article.

The present invention provides a response to both present and anticipated needs for new material systems for IC engine exhaust valves and high temperature structural applications by development of cost effective processing methods for making dispersion strengthened alloy powder particles and products made therefrom having enhanced fatigue and creep resistance and reduced wear for automotive and heavy-duty vehicle applications as well as enhanced corrosion/oxidation resistance at high temperatures.

SUMMARY OF THE INVENTION

The present invention provides in one embodiment a method of making dispersoid-strengthened alloy particles by providing an alloy comprising an environmental (e.g. corrosion or oxidation) resistance-imparting alloying element, a dispersoid-forming element, and a matrix metal, wherein the dispersoid-forming element exhibits a greater tendency to react with a reactive species acquired from an atomizing gas than does the alloying element. The alloy is melted and atomized with the atomizing gas comprising the reactive species so that the reactive species is (a) dissolved in solid solution to at least a depth below the surface of atomized particles for reaction with the disperosid-forming element by subsequent particle heating and/or (b) reacted with the dispersoid-forming element in-situ during atomization to form dispersoids in the atomized particles to at least a depth below the surface of the atomized particles. The atomized alloy particles are solidified as alloy particles or as a deposit of alloy particles. Bodies formed from the dispersion strengthened alloy particles, or deposit thereof, exhibit enhanced fatigue and creep resistance and reduced wear as well as enhanced corrosion/oxidation resistance at high temperatures.

The present invention envisions a post-atomization step of heating the solidified alloy particles, or deposit thereof, to a temperature to react the dispersoid-forming element with the reactive species in solid solution and/or with a pre-existing compound formed between the alloying element and the reactive species so as to form dispersoids in the particle alloy matrix. The solidified alloy particles, or deposit thereof, can be heated by vacuum hot pressing, hot isostatic pressing, hot extrusion, direct hot powder forging or other consolidation process, or by annealing or sintering at superambient temperature.

The present invention also provides in another embodiment atomized alloy particles, or deposit thereof, wherein the particles comprise an alloy matrix comprising the matrix metal and the environmental (corrosion or oxidation) resistance-imparting alloying element in solid solution in the matrix metal, and dispersoids formed in-situ in at least a surface region of the particle alloy matrix. The surface region preferably has a thickness greater than 1 micrometer.

In an illustrative embodiment of the invention for oxide dispersoid formation, the matrix metal is selected from the group consisting of Fe, Ni, Co, Cu, Ag, Au, and Sn while the alloying element is selected from the group consisting of Cr, Mo, W, V, Nb. Ta, Ti, Zr, Ni, Si, and B. For example, when the matrix metal is Fe and the alloying element is Cr, a Fe—Cr ferritic stainless steel type particle alloy matrix is provided.

The dispersoid-forming element is selected from the group consisting of Sc, Y, and a Lanthanide series element having an atomic number in the range of 57 and 71. The reactive species is selected to react with the dispersoid-forming element to form oxide dispersoids in the particle alloy matrix, in this example, but could form nitride, carbide, boride, and other refractory compound dispersoids in the particle matrix with other appropriately selected systems.

The present invention provides cost effective processing methods for making dispersion strengthened alloy particles and bodies and products made from the alloy particles having enhanced fatigue and creep resistance and reduced wear for automotive and heavy-duty vehicle applications as well as enhanced corrosion/oxidation resistance at high temperatures.

The aforementioned advantages of the present invention will become more readily apparent from the following detailed description taken in conjunction with the drawings.

DETAILED DESCRIPTION OF THE INVENTION

Figure 1:
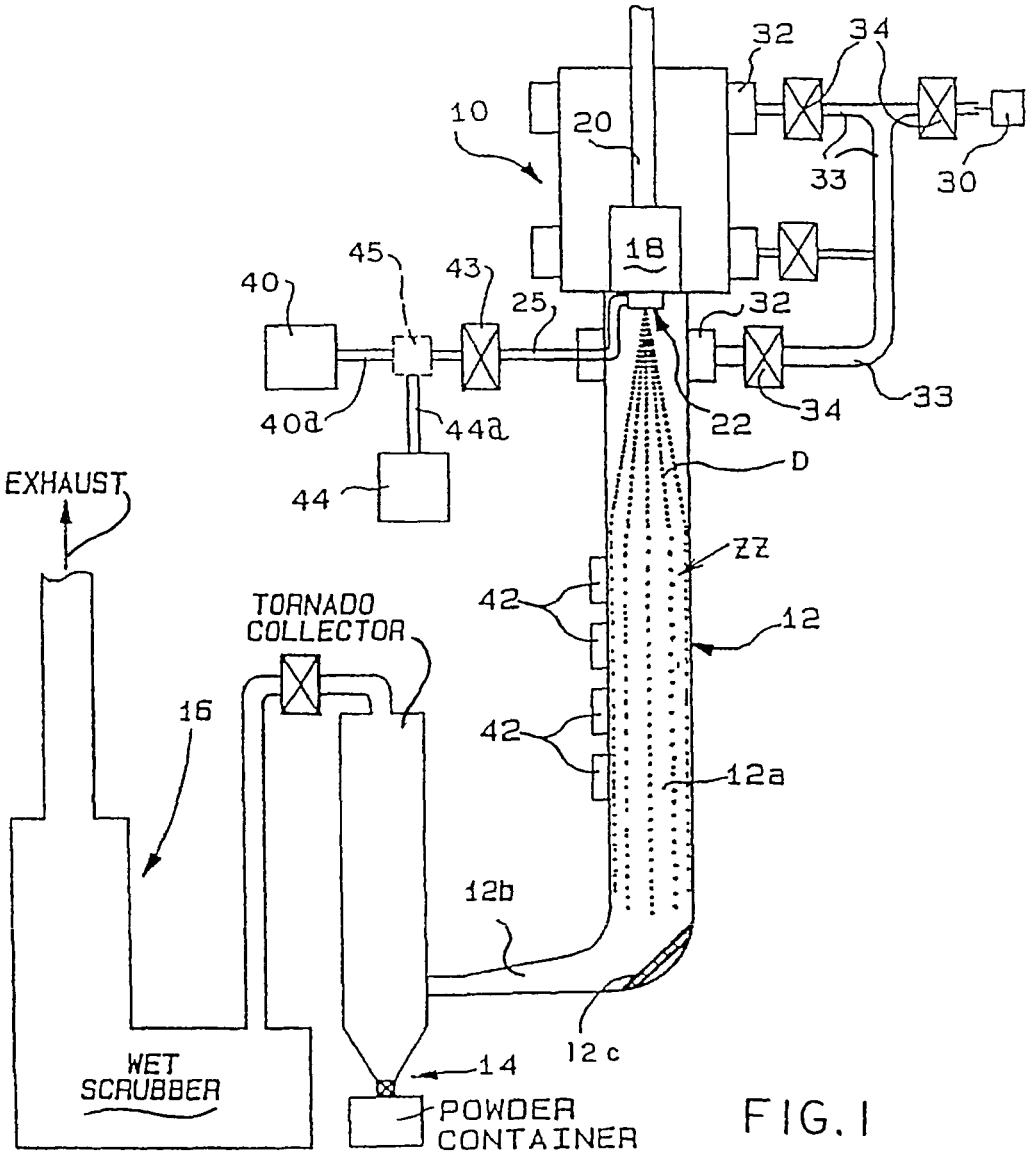
FIG. 1 is a schematic view of atomization apparatus for practicing one embodiment of the invention.

The present invention involves a linked series of alloy design and atomizing parameters of the aforementioned GARS atomizing process that lead to the low-cost production of corrosion and/or oxidation resistant metallic alloy powder particles strengthened by a dispersion of highly refined refractory dispersoids that are extremely resistant to coarsening and strength degradation at elevated temperatures. In practice of an illustrative embodiment of the present invention, an alloy is provided comprising an environmental resistance-imparting (e.g. one or both of corrosion or oxidation resistance) alloying element, a dispersoid-forming element, and a matrix metal. The alloying element and the matrix metal are selected to form a desired particle alloy matrix, which is intrinsically corrosion and/or oxidation resistant by virtue of the alloying element being dissolved primarily in solid solution in the matrix metal.

The alloying element and the dispersoid-forming element are selected such that the alloying element imparts intrinsic corrosion and/or oxidation resistance to the particle alloy matrix and yet does not dominate or interfere with refractory compound (dispersoid) formation during the GARS process described in U.S. Pat. No. 5,368,657 or, most importantly, during subsequent solid state reactions, including hot consolidating, sintering and high temperature heat treating. Although the alloying element can react to some extent with the reactive species, it does not dominate or interfere with formation of the refractory compounds (dispersoids). To this end, the dispersoid-forming element is selected to have a greater energetic tendency (e.g. $\Delta H$ value) to form dispersed refractory compounds (dispersoids) relative to that of the alloying element. Also to this same end, the alloys preferably include an insubstantial amount of Al, and even more preferably are free of Al, so as not to interfere with the dispersoid forming-reaction involving the dispersoid-forming element. Both corrosion/oxidation (environmental) resistance and dispersoid strengthening can be imparted to the alloy powder particles and deposits thereof. The dispersoids can be formed during atomization and/or after atomization in a subsequent particle heating process step conducted at elevated temperature. The GARS process is described in U.S. Pat. No. 5,368,657 of common assignee herewith, the teachings of which are incorporated herein by reference.

The alloying element should not form an instantaneous surface film that substantially stops any additional reactions or dissolution of the reactive gas into the atomized alloy droplets during GARS processing. Thus, each resulting atomized alloy particle should have an alloy matrix that is intrinsically resistant to oxidation and/or corrosion and a thick (greater than at least 1 micrometer) surface region that contains refractory dispersoid particles or, at least an enhanced solubility of the reactive species that may react later during solid state high temperature processing to form additional refractory dispersoids.

For purposes of illustration of oxide dispersion formation and not limitation, the matrix metal can include, but is not limited to, Fe, Ni, Co, Cu, Ag, Au, or Sn, or combinations thereof, although the invention is not limited to any particular matrix metal. Preferred matrix metals include Fe, Ni, and Cu as a result of their common usage in structural components.

The environmental resistance-imparting alloying element can include, but is not limited to, Cr, Mo, W, V, Nb, Ta, Ti, Zr, Ni, Si, or B, or combinations thereof. As mentioned above, the alloying element is selected to dissolve in solid solution in the matrix metal to form a particle alloy matrix and to impart improved intrinsic corrosion and/or oxidation resistance to the particle alloy matrix. For purposes of illustration and not limitation, the matrix metal can comprise Fe and the alloying element can comprise Cr to form a Fe—Cr ferritic stainless steel type particle alloy matrix.

The dispersoid-forming element can include, but is not limited to, Sc, Y and a Lanthanide series element having an atomic number from 57 to 71 and reacts with the reactive species to form oxide dispersoids in the particle alloy matrix.

For purposes of further illustration of oxide dispersion formation and not limitation, the invention can be practiced in connection with the following alloys:

Fe—Cr—Y ferritic stainless steel alloys, Ni—Cr—Y heat resistant alloys, or Cu—Ti—Y structural alloys.

For purposes of illustration of nitride dispersion formation and not limitation, the matrix metal can include, but is not limited to, Fe, Ni, Co, Cu, Ag, Au, or Sn, or combinations thereof, although the invention is not limited to any particular matrix metal. Preferred matrix metals include Fe, Ni, and Cu as a result of their common usage for structural components.

The environmental resistance-imparting alloying element can include, but is not limited to, Mn, Cr, In, B, La, Nb, Ta, or V, or combinations thereof. As mentioned above, the alloying element is selected to dissolve in solid solution in the matrix metal to form a particle alloy matrix and to impart improved intrinsic corrosion and/or oxidation resistance to the particle alloy matrix. For purposes of illustration and not limitation, the matrix metal can comprise Fe and the alloying element can comprise Cr to form a Fe—Cr ferritic stainless steel type particle alloy matrix.

The dispersoid-forming element can include, but is not limited to, Ti, Ce, Sr, Zr, Mg, Hf, Be, or Si, or combinations thereof, that reacts with the reactive species to form nitride dispersoids in the particle alloy matrix.

For purposes of further illustration and not limitation, the invention can be practiced in connection with the following alloys:

Fe—Cr—Zr stainless steel alloys and Ni—V—Mg structural alloys.

GARS Processing

Referring to FIG. 1, a gas atomization apparatus is shown for practicing one embodiment of the present invention. The apparatus includes a melting chamber 10, a drop tube 12 beneath the melting chamber, a powder collection chamber 14 and an exhaust scrubbing system 16. The melting chamber 10 includes an induction melting furnace 18 and a vertically movable stopper rod 20 for controlling flow of melt from the furnace 18 to a melt atomizing nozzle 22 disposed between the furnace and the drop tube. The atomizing nozzle 22 preferably is of the supersonic gas type described in the Anderson U.S. Pat. No. 5,125,574, the teachings of which are incorporated herein by reference with respect to nozzle construction. The atomizing nozzle 22 is supplied with an atomizing gas in a manner to be described through a conduit 25 and an open/close valve 43. As shown in FIG. 1, the atomizing nozzle 22 atomizes melt in the form of a spray of generally spherical, molten droplets D into the drop tube 12. An atomization spray zone ZZ is thus formed in the drop tube 12 beneath or downstream of the nozzle 22 in the drop tube 12 to the elbow leading to lateral section 12*b*.

Both the melting chamber 10 and the drop tube 12 are connected to an evacuation device (e.g., vacuum pump) 30 via suitable ports 32 and conduits 33. Prior to melting and atomization of the melt, the melting chamber 10 and the drop tube 12 are evacuated to a level of about $30\times10^{-3}$ torr to substantially remove ambient air. Then, the evacuation system is isolated from the chamber 10 and the drop tube 12 via the valves 34 shown and the chamber 10 and drop tube 12 are positively pressurized by an inert gas (e.g., argon to about 1.1 atmosphere) to prevent entry of ambient air thereafter.

The drop tube 12 includes a vertical drop tube section 12*a* and a lateral section 12*b* that communicates with the powder collection chamber 14. The drop tube vertical section 12*a* has a generally circular cross-section having a diameter in the range of 1 to 3 feet, a diameter of 1 foot being used in the Examples set forth below. A disposable thin sheet metal (e.g. type 304 stainless steel or Ta metal) splash member 12*c* is fastened by bolts (not shown) at the elbow or junction of the drop tube vertical section 12*a* and lateral section 12*b*.

The length of the vertical drop tube section 12*a* is typically about 9 to about 16 feet, a preferred length of 9 feet being used in the Examples set forth below, although other lengths can be used in practicing the invention.

Powder collection is accomplished by separation of the powder particles/gas exhaust stream in the tornado centrifugal dust separator/collection chamber 14 by retention of separated powder particles in the valved powder-receiving container shown in FIG. 1.

A plurality of temperature sensing means 42 (shown schematically), such as radiometers or laser doppler velocimetry devices, may be spaced axially apart along the length of the vertical drop section 12*a* to measure the temperature or velocity, respectively, of the atomized droplets D as they fall through the drop tube and cool in temperature.

A method embodiment of the present invention involves melting the above-described alloy comprising a corrosion and/or oxidation resistance-imparting alloying element, a dispersoid-forming element, and a matrix metal, wherein both the dispersoid-forming element and the alloying element exhibit a tendency to react with a reactive species acquired from the atomizing gas during atomization, but the dispersoid-forming element exhibits a greater tendency to react with the dissolved reactive species acquired from the atomizing gas, or with the alloying element/reactive species compounds, during post-atomization solid state reactions. In particular, a superheated melt comprising the alloy is formed in a crucible (not shown) preferably under an inert gas atmosphere in the melting furnace 18 and atomized using atomizing nozzle 22 to produce atomized powder particulates. The atomizing gas supplied to the nozzle 22 comprises a mixture including a carrier gas and a second reactive gas or liquid to provide the reactive atomic species that is reactive with both the alloying element and disperoid-forming element in a manner to form dispersoids in-situ in the particle alloy matrix and/or that becomes trapped as supersaturated reactive atomic species in the resulting solid matrix.

The carrier gas and reactive second gas or liquid are supplied either from a premixed high pressure gas mixture cylinder or from conventional sources, such as high pressure cylinders or pressurized bottles 40 and 44, respectively, and mixed in the common conduit 25 that is communicated to the atomizing nozzle 22. The carrier gas typically comprises an inert gas, such as preferably ultra high purity argon, although the invention is not limited to use of inert gas as a carrier gas. If a liquid reactive material is used, it can be supplied from a pressurized cylinder and mixed with the carrier gas in a carburetor-like chamber 45 (shown schematically in FIG. 1) located at the junction of the individual supply conduits 40*a*, 44*a*.

The reactive gas or liquid is selected to provide the reactive species that is (a) dissolved in solid solution at a superequilibrium concentration to at least a depth below the surface of atomized particles for reaction with the disperosid-forming element by subsequent particle heating and/or (b) reacted with the alloying element and the dispersoid-forming element in-situ during atomization to form dispersoids in the atomized particles to at least a depth below the surface of said atomized particles. The surface region preferably has a thickness or depth greater than 1 micrometer and preferably through the entire diameter of the particle.

For example, the second reactive gas can comprise ultra high purity oxygen or nitrogen when it is desired to form alloy particles having atomic oxygen or nitrogen dissolved in solid solution and/or when it is desirable to form oxide or nitride dispersoids in-situ therein during atomization. The second, reactive gas is not limited to nitrogen or oxygen and can comprise other ultra high purity gases to form boride, carbide, silicide and fluoride dispersoids in the matrix metal. For example, ultra high purity borane gas can be used when it is desired to form powder particles having atomic boron dissolved in solid solution therein for purposes of forming boride dispersoids in-situ therein by a subsequent particle heating and/or to form boride dispersoids in-situ during atomization. Carbide disperoids can be formed using an aromatic hydrocarbon as the reactive species of the atomizing gas. Reactive liquids for use with the carrier gas include, but are not limited to, $NH_3$ or metal carbonyl. Other appropriate carrier gas/reactive gas mixtures can used as the atomizing gas to make alloy particles having atomic oxygen, carbon, silicon, germanium, etc., dissolved in solid solution therein for subsequent heat treatment and/or to form oxide, carbide, silicide, germanides, etc. dispersoids in-situ therein during atomization.

A high superequilibrium concentration of the reactive species including, but not limited to, oxygen and nitrogen can be dissolved in solid solution in the atomized powder particles by proper selection of the temperature of the melt and the ratio of the carrier gas to the second, reactive gas or liquid. In particular, a high concentration of dissolved reactive atomic species of the second, reactive gas in the atomized powder particles beyond the predicted equilibrium concentration can be achieved by atomization of the melt (1) at a melt superheat temperature that is not high enough to cause vaporization of the atomized droplets in the spray zone ZZ and yet is high enough to promote high fluidity and atomic mobility within the liquid atomized droplets and (2) at a ratio of carrier gas-to-second gas that is high enough (low enough partial pressure of the second gas) to substantially prevent reaction of the second gas with the atomized melt in the atomization spray zone ZZ in a manner to form compound(s) therewith and that is low enough (high enough partial pressure of the second gas) to achieve substantial dissolution of the atomic specie of the second gas in at least the surface region of the atomized melt particles in the atomization spray zone ZZ. Preferably, the carrier gas is present as a majority (vol. %) of the atomizing gas, while the second gas is present as a minority (vol. %) of the atomizing gas.

Typically, both a superequilibrium concentration of the reactive species dissolved in solid solution and formation of refractory compound dispersoids in the atomized particles is achieved during atomization.

The cooling rate of the melt droplets in the atomization spray zone ZZ is sufficiently rapid to trap or quench the dissolved atomic reactive species of the second, reactive gas in solid solution to at least a substantial depth below the outer surface of the atomized particles (e.g. a region at least about 1.0 micron in depth from the outer particle surface) as they rapidly solidify in the atomization spray zone ZZ. The particles solidify wholly (i.e. through the entire cross-section) in the atomization spray zone ZZ to provide a generally spherical particle shape and trap the dissolved species in the matrix metal.

The atomization parameters (e.g. gas stoichiometry, melt superheat, atomization gas pressure, chemistry of gas species) can be adjusted to achieve the aforementioned high supersaturation of the reactive species and/or dispersoid formation throughout the particle cross-section, rather than in a surface region. For example, at a given level of reaction kinetics, an enhanced atomization energy level can produce smaller atomized droplets which, on average, would experience penetration of the dissolved atomic specie throughout the entire particle diameter, as the supersaturated surface region or zone approaches overlap at the droplet center. Atomization parameter(s) can be adjusted to this end. Supersaturation of the reactive species can be achieved across the substantially whole particle rather than a surface region, if the droplets involved in the reaction are sufficiently small.

Post-Atomization Processing

The present invention envisions post-atomization processing of the atomized alloy particle to form a body or product from the atomized alloy particles. In one embodiment, the next step in the processing of the atomized alloy particles comprises high temperature near-net shape consolidation to essentially full density by one of several methods. including vacuum hot pressing (VHP), hot isostatic pressing (HIP), hot extrusion, or direct (hot) powder forging. It is during the thermal excursion of the VHP, HIP, extrusion, or forging process that any dissolved, but unreacted, dissolved gas may diffuse locally and form additional refractory compounds as dispersoids within the particle matrix microstructure.

The selected method for consolidation of the alloy particles will depend on the desired net shape and size of the final product and the need to minimize the number of processing steps to produce it. For example, if the desired product is a bar or tube, hot extrusion may be the most desirable powder consolidation step. Post-consolidation annealing at high temperatures may also be desirable to promote further oxygen exchange reactions and formation of the more stable dispersoids, at the expense of the less stable oxide phase. It should also be noted that a final forging step or additional extrusion/swaging/drawing steps may also be desired to produce enhanced interparticle bonding or increased microstructural refinement or texturing. Conventional machining can be used to produce each final net shape part.

The present invention also envisions in still another embodiment post-atomization processing that involves selecting only ultrafine powder particles (typically diameter <25 μm) from the atomization batch yield. These ultra fine powder particles are mixed with a processing binder and used in a powder injection molding method to form an oversize net shape body. The processing binder (typically a low melting, volatile polymer) is removed, and then the body is sintered with uniform shrinkage to full density and final net shape. It is during the thermal excursion of the high temperature sintering process that any dissolved, but unreacted, atomizing gas specie may diffuse locally and form additional refractory compounds (dispersoids) within the alloy matrix microstructure.

In a still further embodiment, the present invention envisions the spray deposition of the atomized alloy particles on a mandrel or other support to deposit a near-full density preform. The spray deposition process involves interrupting the atomization spray after the GARS reaction has occurred and before the atomized particles have solidified completely. This interruption is achieved by appropriately positioning a mandrel support at a location in the path of the atomization spray so that the partially or fully molten atomized particles impinge on the mandrel support and deposit and solidify thereon. The atomized particles impact the mandrel support as particles splats which build-up over time to form a deposit of solidified particle splats. The well known "Osprey" process invented by Singer and co-workers describes such a spray deposition method.

By using this spray deposition process, the handling of loose powder particles can be avoided and improved interparticle bonding and microstructural refinement can be achieved without secondary thermal-mechanical processing. Since the spray deposited pre-forms (typically bodies such as tubular members or cylindrical mounds) are not of full density, a hot forging or hot extrusion step is usually needed to produce a fully consolidated, near-net shape part that is ready for conventional machining to produce each final net shape part. It is during the thermal excursion of the forging or extrusion process that any dissolved, but unreacted, atomizing gas reactive species may diffuse locally and react with the dispersoid-forming element to form additional refractory phases within the microstructure of the particle alloy matrix.

In the above post-atomization processing embodiments, due to the purposeful presence of the competing (but unequal) reactive alloying element and the dispersoid-forming element; e.g., Cr and Y, any Cr oxide phase formed on the prior particle boundaries during atomization can serve as an additional source of oxygen for reaction with the more oxidizable component, Y, to form more finely dispersed $Y_2O_3$ particles adjacent to all of the prior particle boundaries. Thus, not only are the desirable (most stable) dispersoids formed in greater numbers, any semi-continuous Cr oxide films on the prior particle surfaces are at least partially dissolved and allow improved oxidation/corrosion resistance, interparticle bonding, and microstructural integrity.

Although the corrosion/oxidation resistance-imparting alloying element can react to some extent with the reactive species acquired from the atomizing gas, it does not dominate refractory phase formation by the dispersoid-forming element during the GARS atomizing process or during subsequent solid state reactions, including sintering and high temperature heat treating. In other words, it is desirable that the oxidation and/or corrosion resistant alloying element should not form an instantaneous surface film that stops any additional reactions or dissolution of the reactive gas species into the atomized alloy droplets during GARS processing. Thus, each resulting atomized alloy particle should have an alloy matrix that is intrinsically resistant to oxidation and/or corrosion and a thick (greater than at least 1 micrometer) surface region that contains refractory phase dispersoids or, at least an enhanced solubility of the reactive gas species that may react later during solid state high temperature processing to form additional refractory phases.

Example 1 sets forth conditions for GARS processing and spray deposition of an iron alloy having Cr as a corrosion/oxidation resistance-imparting solid solution alloying element and Y as a dispersoid-forming element. The nominal composition of the alloy, in weight %, was 12.5% Cr, 1.0% Y, and balance Fe. The Cr alloying element was present in an amount effective to impart intrinsic corrosion and oxidation resistance to the particle alloy matrix, which corresponds to a Type 410 ferritic stainless steel at least with respect to Fe and Cr concentrations. The Y is provided in an amount to react in the surface region and elsewhere in the particle matrix with dissolved O (reactive species) and with any oxide compounds of Cr to form refractory dispersoids in the particle alloy matrix during atomization and/or later during solid state high temperature processing.

EXAMPLE 1

The melting furnace was charged with 3800 g, comprising 3275 g of Fe (Tophet, high purity grade), 475 g of Cr (Tosoh, high purity grade), and 50 g of an Fe—Y chill cast button (Fe-76Y, wt. %) using Y of 99.5% purity. The charge was melted in the induction melting furnace in a high purity, coarse grain zirconia (MgO-stabilized) crucible, obtained from Zircoa. A pour tube made of plasma arc spray deposited zirconia ($Y_2O_3$ stabilized) and a stopper rod made of hard fired alumina, obtained from Coors Ceramics, were used. The charge was melted in the induction furnace after the melting chamber and the drop tube were evacuated to $3\times10^{-5}$ atmosphere and then pressurized with argon to 1.1 atmosphere. The melt was heated to a temperature of 1750 C (providing about 250 C superheat above the alloy liquidus temperature). After a hold period of 2 minutes to stabilize the molten alloy temperature, the melt was fed via the pour tube to the atomizing nozzle by gravity flow upon raising of the alumina stopper rod. The atomizing nozzle was of the type described in U.S. Pat. No. 5,125,574, the teachings of which are incorporated herein by reference with respect to nozzle construction.

The atomizing gas comprised a mixture of argon and oxygen in a ratio of 95:5 (i.e., 95 vol. % Ar and 5 vol. % $O_2$) and was supplied as a factory made mixture. The argon/oxygen gas mixture was supplied at 4.5 MPa (650 psig), measured at the respective gas supply regulator, to the atomizing nozzle. The flow rate of the atomizing gas mixture to the atomizing nozzle was about 5.5 $m^3$/min.

This atomization experiment was performed to test the capacity for internal oxidation of the above Fe—Cr—Y alloy during reactive gas atomization using the Ar-5% by volume $O_2$ gas mixture for primary atomization of the melt to maximize the aggressiveness of the GARS reaction. A partial (9% poured) atomization run was completed, generating about 0.35 kg of total atomized powder particle yield.

The atomized powder particle yield was screened to select a size class from 20 to 53 microns, which represented about 67% of the collected powder, and 140 g of this powder was tested for sintering characteristics of die pressed compacts. The remainder of the powder and a spray deposition sample formed by capturing a portion of the partially solidified spray (about 38 cm downstream from the nozzle) in a simple mold cavity support that also was collected during the run were retained for several types of characterization experiments to determine the effect of the innovative processing.

Figure 2A:
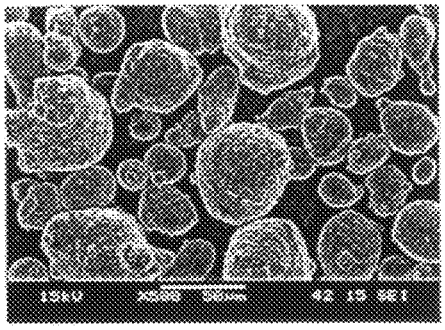
FIG. 2*a* and FIG. 2*b* are SEM micrographs of 20-53 μm diameter (dia.) powder of Fe-12.5Cr-1Y, showing in FIG. 2*a* exterior surfaces of as-atomized powder particles (secondary electron contrast), and in FIG. 2*b* cross-section (unetched) of powder particles with partially adherent Cr-oxide surfaces (backscattered electron contrast).
Figure 2B:
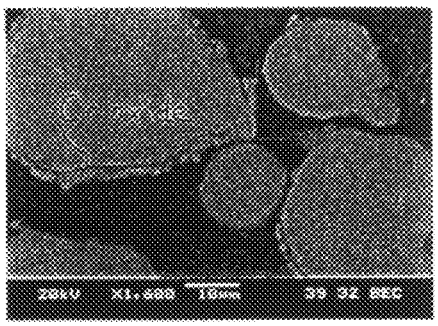

A powder sample and a portion of the spray deposit were subjected to SEM (scanning electron microscopy) examination. FIG. 2*a* and FIG. 2*b* show as-atomized Fe-12.5Cr-1Y powder having 20-53 μm diameter wherein FIG. 2*a* shows exterior surfaces of as-atomized powder particles (secondary electron contrast) and wherein FIG. 2*b* shows cross-section (unetched) of powder particles with partially adherent Cr-oxide surfaces (backscattered electron contrast).

Figure 3A:
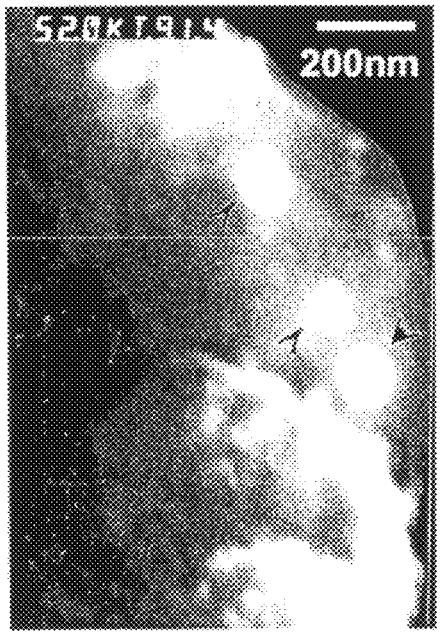
FIG. 3*a* and FIG. 3*b* are TEM micrographs of spray deposit sample of Fe-12.5% Cr-1Y % (% by weight) revealing in FIG. 3*a* spherical yttria particles (see arrowhead markers) of about 100 nm diameter within a solidified grain (dark field contrast) and in FIG. 3*b* (reduced magnification) of yttria particles at various locations (bright field contrast) in the spray deposit microstructure.
Figure 3B:
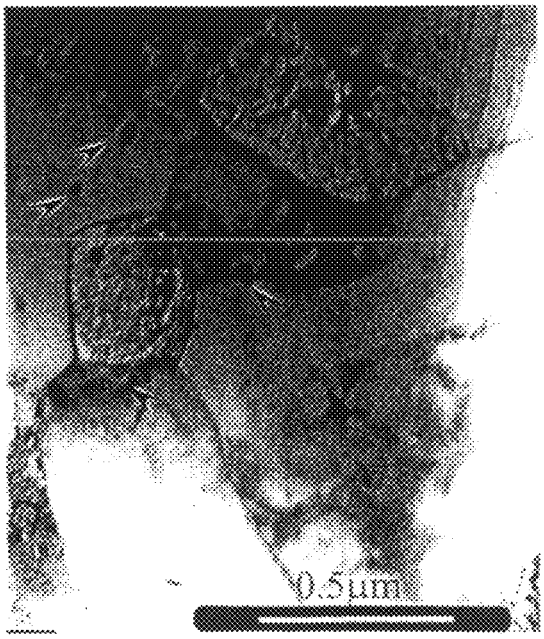
Figure 4A:
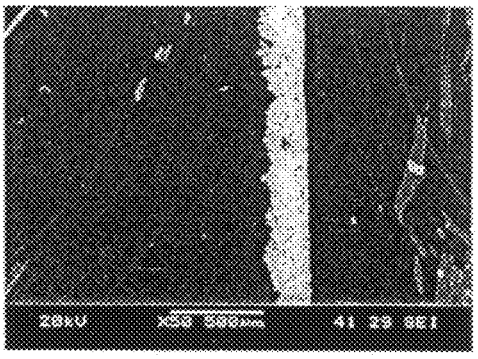
FIG. 4*a* and FIG. 4*b* are cross-section (unetched) SEM micrographs of a spray deposited structure of Fe-12.5% Cr-1% Y, showing in FIG. 4*a* (low magnification) a rough top surface of deposit and in FIG. 4*b* (increased magnification) individual splatted droplets with some internal porosity, where the spray direction is from left to right of the micrographs.
Figure 4B:
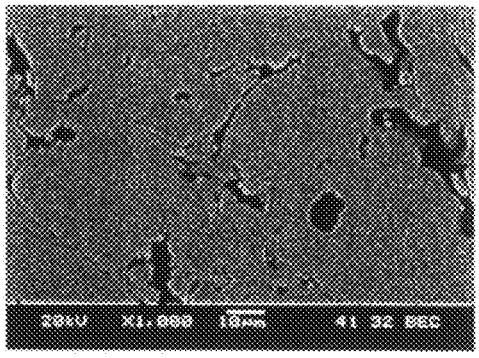
Figure 5:
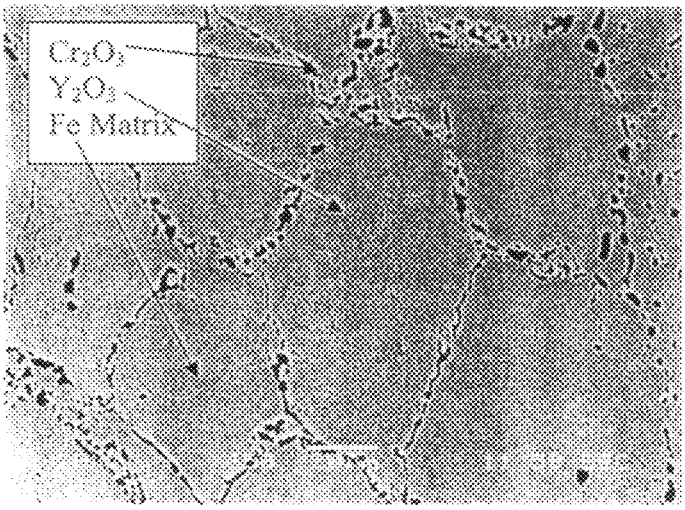
FIG. 5 is an SEM micrograph of 20-53 μm dia. powder of Fe-12.5% Cr-1% Y, showing cross-section (unetched) of HIP consolidated microstructure with partially dissolved Cr-oxide particles that surround each prior particle boundary (backscattered electron contrast).
Figure 6:
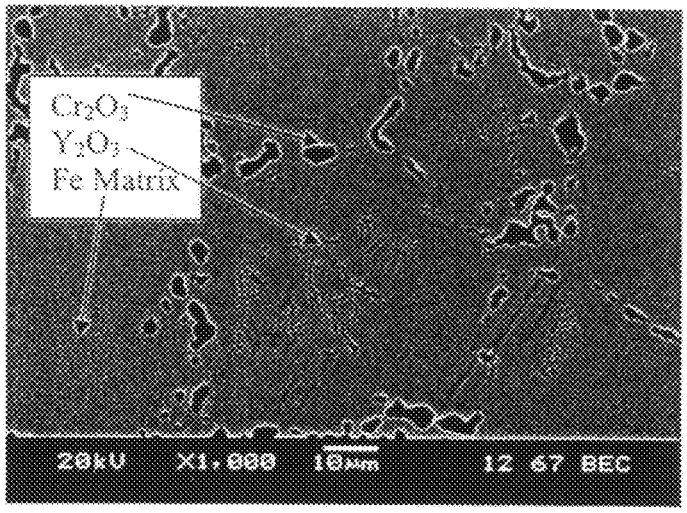
FIG. 6 is an SEM micrograph of 20-53 μm dia. powder of Fe-12.5% Cr-MY, showing cross-section (unetched) of HIP consolidated microstructure and vacuum annealed (1500 C, 4 hours) microstructure with further dissolved and coarsened Cr-oxide particles that surround each prior particle boundary (backscattered electron contrast).
Figure 7:
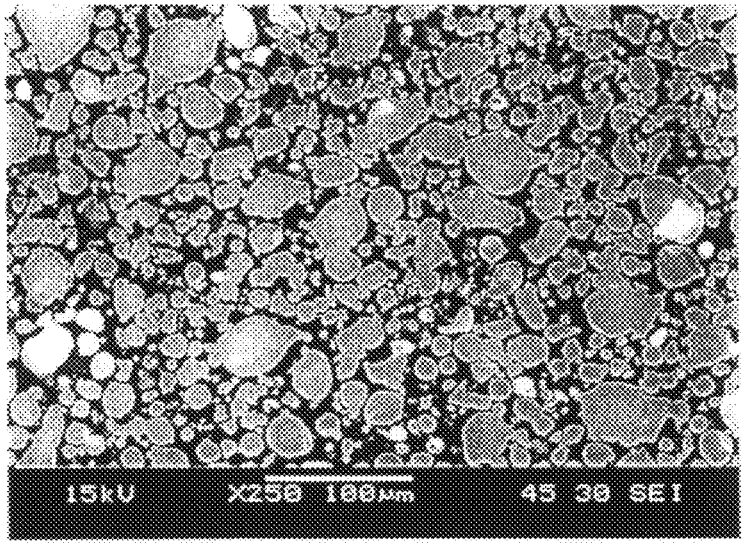
FIG. 7 is a cross-sectioned (unetched) SEM micrograph of the result of loose powder sintering of less than 20 μm diameter powder of Fe-12.5% Cr-1% Y, showing partially sintered microstructure with sufficient strength for handling, but with a highly porous structure (backscattered electron contrast).

SEM observation of the spray deposit revealed the desired $Y_2O_3$ particles in the spray deposit sample (see FIGS. 3*a* and 3*b*). Also, a splatted appearance of the spray deposit sample was observed by SEM (transmission electron microscopy), showing the partial decoration of splat boundaries by the oxide fragments from the oxidized droplet surfaces, as given in FIGS. 4*a* and 4*b*. Sintering tests were conducted on the powder that was provided. The sintering tests revealed an encouraging gain in sintering temperature. The powder and another portion of the spray deposition sample also were subjected to e-beam characterization, and a set of observations were completed, confirming the presence of the desired yttrium oxide particles by both Auger electron spectroscopy and wavelength dispersive spectroscopy. This was consistent with TEM evidence that revealed spherical Y-containing particles of about 50 nm in diameter within the powder particles. SEM analysis has shown that the HIP consolidated microstructure (hot isostatic pressing at 1300 C and 303 MPa for 2 hours in a stainless steel can) has partially dissolved Cr oxide phase on the prior particle boundaries and $Y_2O_3$ particles and Y-containing phase regions (demonstrated by EDS line scans-not shown) within the prior particle microstructures, as shown in FIGS. 5*a* and 5*b*. Additional SEM has shown how high temperature annealing (at 1500 C) of the HIP sample resulted in improved interparticle bonding from more dissolution of this Cr oxide phase on the prior particle boundaries and additional $Y_2O_3$ particles and Y-containing phase regions (demonstrated by EDS line scans-not shown) incorporated in the consolidated microstructure (see FIG. 6). Also, in a binder-less simulation of the injection molding process, loose powder sintering of dia. <20 μm powder was performed in vacuum at 1300 C for 80 hours and generated a partially sintered compact with a high fraction of interconnected porosity, as shown in FIG. 7.

Example 2 sets forth conditions for GARS processing of an iron alloy having Cr as a corrosion/oxidation resistance-imparting solid solution alloying element and Y as a dispersoid-forming element. The nominal composition of the alloy, in weight %, was 13.5% Cr, 2.0% Y, and balance Fe. The Cr alloying element was present in an amount effective to impart intrinsic corrosion and oxidation resistance to the particle alloy matrix, which corresponds to the Cr-rich side of the specifications of a Type 410 ferritic stainless steel at least with respect to Fe and Cr concentrations. The Y is provided in an amount to enhance reaction in the surface region and elsewhere in the particle matrix with dissolved O (reactive species) and with any oxide compounds of Cr to form refractory dispersoids in the particle alloy matrix during atomization and/or later during solid state high temperature processing.

EXAMPLE 2

The melting furnace was charged with 4050 g, comprising 3490 g of Fe (Tophet, high purity grade), 506 g of Cr (Tosoh, high purity grade), and 54 g of an Fe—Y chill cast button (Fe-76Y, wt. %) using Y of 99.5% purity. The charge was melted in the induction melting furnace in a high purity, coarse grain zirconia (MgO-stabilized) crucible, obtained from Zircoa. A pour tube made of plasma arc spray deposited zirconia ($Y_2O_3$ stabilized) and a stopper rod made of hard fired alumina, obtained from Coors Ceramics, were used. The charge was melted in the induction furnace after the melting chamber and the drop tube were evacuated to $3\times10^{-5}$ atmosphere and then pressurized with argon to 1.1 atmosphere. The melt was heated to a temperature of 1750 C (providing about 250 C superheat above the alloy liquidus temperature). After a hold period of 2 minutes to stabilize the molten alloy temperature, the melt was fed via the pour tube to the atomizing nozzle by gravity flow upon raising of the alumina stopper rod. The atomizing nozzle was of the type described in U.S. Pat. No. 5,125,574, the teachings of which are incorporated herein by reference with respect to nozzle construction.

The atomizing gas comprised a mixture of argon and oxygen in a ratio of 95:5 (i.e., 95 vol. % Ar and 5 vol. % $O_2$) and was supplied as a factory made mixture. The argon/oxygen gas mixture was supplied at 6.9 MPa (1000 psig), measured at the respective gas supply regulator, to the atomizing nozzle. The flow rate of the atomizing gas mixture to the atomizing nozzle was about 10.3 $m^3$/min.

This atomization experiment was performed to test the capacity for internal oxidation of the above Fe—Cr—Y alloy during reactive gas atomization using the Ar-5% by volume $O_2$ gas mixture for primary atomization of the melt to maximize the aggressiveness of the GARS reaction. A partial (16% poured) atomization run was completed, generating about 0.67 kg of total atomized powder particle yield.

The atomized powder particle yield was screened to select a size class from 20 to 53 microns, which represented about 36% of the collected powder, and 100 g of this powder was subjected to testing of sintering characteristics of a die pressed compact. Also, the powder yield was screened to select a size class below 20 microns, which represented about 35% of the collected powder, and 100 g of this powder was provided for additional testing of sintering characteristics of a die pressed. The remainder of the powder that was collected during the run was retained for several types of characterization experiments to determine the effect of the innovative processing.

Figure 8:
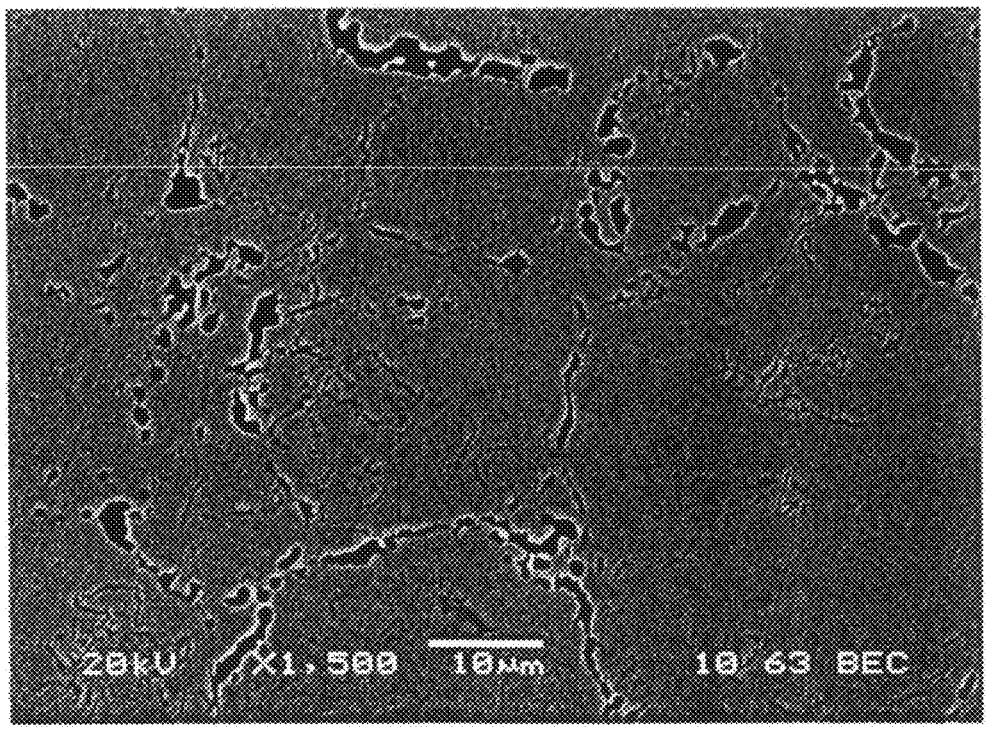
FIG. 8 is an SEM micrograph of 20-53 μm dia. powder of Fe-13.5% Cr-2% Y, showing cross-section (unetched) of HIP consolidated microstructure with partially dissolved Cr-oxide particles that surround each prior particle boundary (backscattered electron contrast).
Figure 9:
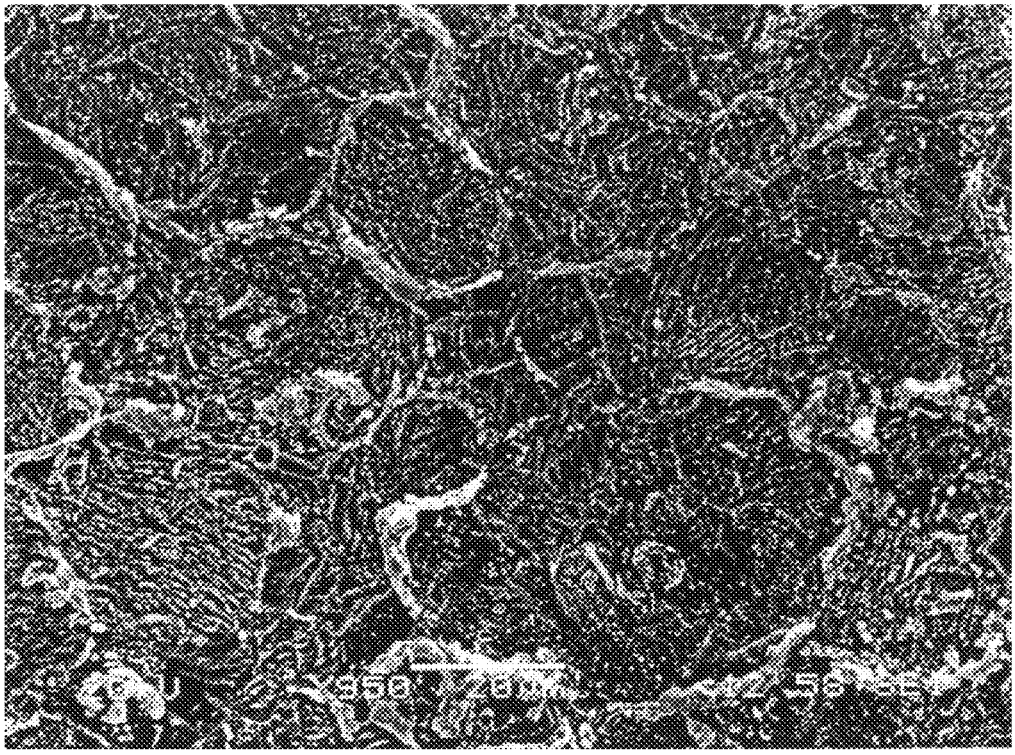
FIG. 9 is an SEM micrograph of 20-53 μm dia. powder of Fe-12.5% Cr-1% Y, showing cross-section (etched) of HIP consolidated microstructure with partially dissolved Cr-oxide particles that surround each prior particle boundary (secondary electron contrast).
Figure 10:
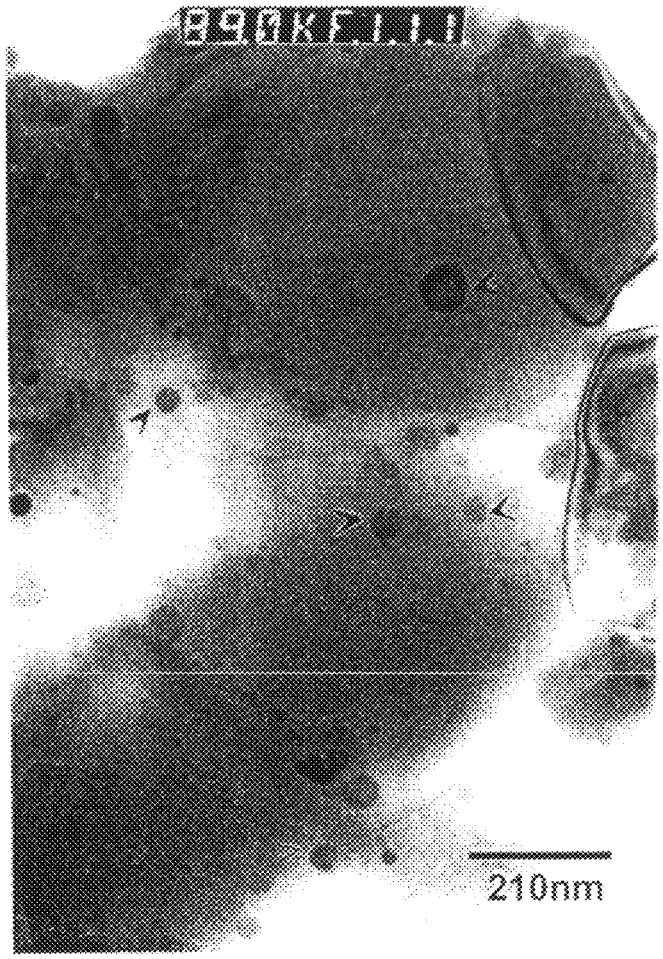
FIG. 10 is a TEM micrograph (bright field contrast) of HIP consolidated microstructure made from 20-53 μm dia. powder of Fe-13.5% Cr-2% Y, showing spherical yttria dispersoids (see arrowhead markers) within grains.
Figure 11:
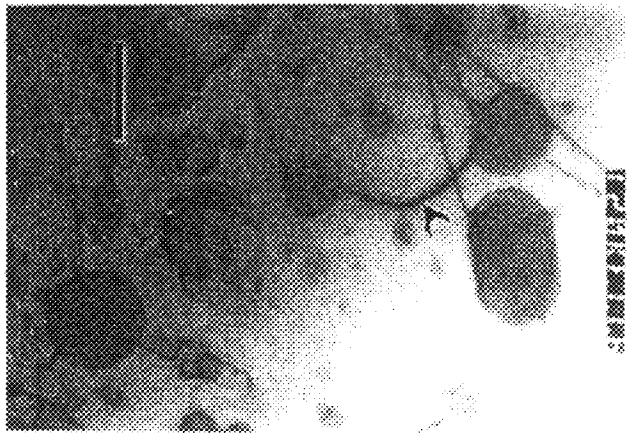
FIG. 11 is a TEM micrograph (bright field contrast) of HIP consolidated microstructure made from 20-53 μm dia. powder of Fe-13.5% Cr-2% Y, showing a dislocation line (see arrowhead marker) that is pinned and bowed between two adjacent yttria dispersoids, where the marker line is 100 nm in length.

SEM examination has shown that the HIP consolidated microstructure (hot isostatic pressing at 1300 C and 303 MPa for 2 hours in a stainless steel can) has partially dissolved Cr oxide phase on the prior particle boundaries and additional $Y_2O_3$ particles and Y-containing phase regions within the prior particle microstructures (demonstrated by EDS line scans-not shown), as shown in FIG. 8. The microstructure in FIG. 9 also shows that several grains are present typically within each prior particle boundary. TEM observations, along with EDS analysis (not shown) of the composition, established that yttria dispersoids of about 40-70 nm in diameter are present within the grains of the HIP microstructure, as shown in the micrograph of FIG. 10. Also, in FIG. 11, a TEM micrograph shows that a dislocation line is pinned and bowed between two adjacent yttria dispersoid particles in the microstructure, which is evidence for dispersion strengthening.

The present invention is advantageous to provide internally dispersion hardened GARS alloy particles, which provide the ability for further strengthening during consolidation and/or heat treating and which may be able to duplicate the strengthening and high temperature stability of previous mechanically alloyed Ni-base powders at a fraction of the material and processing cost. The atomized alloy particles pursuant to the invention have been consoldiated by hot isostatic pressing (HIP) to full density and press/sinter consolidation (with residual porosity) and may be direct (hot) extruded into perform shapes for forging into final parts or metal injection molded directly into net shapes. The atomized alloy particles also can be advantageous for direct spray deposition of oxide dispersion strengthened billet performs, which can be forged.

Moreover, it is thought that the present invention and many of its attendant advantages will be understood from the foregoing description and it will be apparent that various changes may be made in the form, construction and arrangement of the parts of the invention described herein without departing from the spirit and scope of the invention or sacrificing all of its material advantages. The form hereinbefore described being merely a preferred or exemplary embodiment thereof.

While the invention has been described in terms of specific embodiments thereof, it is not intended to be limited thereto but rather only to the extent set forth hereafter in the following claims.

We claim:

1. Atomized alloy particles, each comprising a matrix metal comprising Ni, an environmental resistance-imparting alloying element substantially in solid solution in the matrix metal to provide a particle alloy matrix, and dispersoids formed in-situ in the particle alloy matrix during atomization wherein the dispersoids include a dispersoid-forming element that is selected from the group consisting of Sc, Y, and a Lanthanide series element having an atomic number from 57 to 71, wherein the particles include a surface compound thereon formed during atomization by reaction of a reactive species and the alloying element.

2. The particles of claim 1 having at least a surface region that contains the dispersoids.

3. The particles of claim 2 wherein the surface region has a thickness greater than 1 micrometer.

4. The particles of claim 1 wherein the alloying element is selected from the group consisting of Cr, Mo, W, V, Nb, Ta, Ti, Zr, Si and B.

5. The particles of claim 1 wherein the dispersoids include a dispersoid-forming element that is selected from the group consisting of Ti, Ce, Sr, Zr, Mg, Hf, Be, and Si.

6. The particles of claim 1 wherein the dispersoids comprise a refractory compound that comprises oxygen, nitrogen, carbon, boron, silicon, or fluorine.

7. A deposit comprising the atomized alloy particles of claim 1 deposited on a support.

8. A consolidated body comprising the deposit of claim 7 that is hot extruded or hot forged.

9. A consolidated body comprising the particles of claim 1 that are vacuum hot pressed, hot isostatic pressed, hot extruded, or direct hot powder forged.

10. The particles of claim 1 wherein the surface compound comprises a surface oxide formed by reaction of the reactive species that comprises oxygen and the alloying element.

11. A sintered body comprising previously atomized alloy particles, each particle comprising a matrix metal comprising Ni, an environmental resistance-imparting alloying element substantially in solid solution in the matrix metal to provide a particle alloy matrix, and dispersoids formed in-situ in the particle alloy matrix during atomization wherein the dispersoids include a dispersoid-forming element that is selected from the group consisting of Sc, Y, and a Lanthanide series element having an atomic number from 57 to 71, wherein the particles include a surface compound thereon formed during atomization by reaction of a reactive species and the alloying element, wherein said particles of said sintered body are sintered together and wherein the surface compound formed on the particles during atomization by reaction of the reactive species and the alloying element functions during sintering as a source of the reactive species to form more dispersoids in the sintered body.

12. A sintered body comprising a deposit comprising previously atomized particles deposited on a support, each particle comprising a matrix metal comprising Ni, an environmental resistance-imparting alloying element substantially in solid solution in the matrix metal to provide a particle alloy matrix, and dispersoids formed in-situ in the particle alloy matrix during atomization wherein the dispersoids include a dispersoid-forming element that is selected from the group consisting of Sc, Y, and a Lanthanide series element having an atomic number from 57 to 71, wherein the particles include a surface compound thereon formed during atomization by reaction of a reactive species and the alloying element, wherein the particles of said sintered body are sintered together and wherein the surface compound formed on the particles during atomization by reaction of the reactive species and the alloying element functions during sintering as a source of the reactive species to form more dispersoids in the sintered body.

* * * * *